US007129649B2

(12) United States Patent
Kästle

(10) Patent No.: US 7,129,649 B2
(45) Date of Patent: Oct. 31, 2006

(54) BALLAST WITH BRAKING INDUCTANCE

(75) Inventor: Herbert Kästle, Traunstein (DE)

(73) Assignee: Patent-Treuhand-Gesellschaft fur Elektrisch Gluhiampen mbH (DE)

( * ) Notice: Subject to any disclaimer, the term of this patent is extended or adjusted under 35 U.S.C. 154(b) by 0 days.

(21) Appl. No.: 11/097,192

(22) Filed: Apr. 4, 2005

(65) Prior Publication Data

US 2005/0218833 A1 Oct. 6, 2005

(30) Foreign Application Priority Data

Apr. 2, 2004 (DE) ..... 10 2004 016 389
Aug. 2, 2004 (DE) ..... 10 2004 037 382

(51) Int. Cl.
*H05B 41/16* (2006.01)

(52) U.S. Cl. ..... 315/274; 315/276; 315/282

(58) Field of Classification Search ..... None
See application file for complete search history.

(56) References Cited

U.S. PATENT DOCUMENTS

| | | | | |
|---|---|---|---|---|
| 6,459,214 | B1 * | 10/2002 | Chen et al. | 315/247 |
| 2001/0020830 | A1 | 9/2001 | Rast et al. | 315/172 |
| 2002/0041165 | A1 | 4/2002 | Cammack | 315/291 |
| 2002/0050797 | A1 * | 5/2002 | Lechner | 315/224 |
| 2004/0257000 | A1 * | 12/2004 | Langeslag | 315/209 R |

FOREIGN PATENT DOCUMENTS

| | | |
|---|---|---|
| EP | 0 314 077 A2 | 5/1989 |
| EP | 0 855 850 A1 | 7/1998 |
| GB | 2 319 677 A | 5/1998 |
| WO | 02/30162 | 4/2002 |
| WO | 03/024161 | 3/2003 |

OTHER PUBLICATIONS

Euopean Patent Office Search Report (dated May 23, 2005; 3 pages total) for related European Patent Application No. 05 00 4716.

* cited by examiner

*Primary Examiner*—Tuyet Thi Vo
(74) *Attorney, Agent, or Firm*—Fitch, Even, Tabin & Flannery

(57) ABSTRACT

A ballast for at least one lamp at least two switches arranged in series; a control circuit for alternately opening and closing the two switches; a connection for applying a supply voltage to the two switches; a resonant starting circuit coupled on the input side to the junction point between the two switches and on the output side to a first connection for the lamp, the resonant starting circuit having a resonant inductance arranged in series with the junction point between the two switches ($S_1$, $S_2$) and the first connection for the lamp, and a resonant capacitance arranged for alternating current purposes in parallel with the first and second connections for the lamp, a first braking inductance which, for alternating current purposes, is firstly arranged in series with the first of the two connections for the lamp and secondly in parallel with the resonant capacitance.

11 Claims, 3 Drawing Sheets

BALLAST WITH BRAKING INDUCTANCE

FIELD OF THE INVENTION

The present invention relates to a ballast for at least one lamp, in particular a ballast in accordance with the preamble of patent claim 1.

The problem on which the invention is based is described, for reasons of better comprehensibility, using the example of a high-pressure discharge lamp, as are described by way of example in WO 02/30162 A2, WO 03/24161 A1 or US 2002/0041165 A1. The invention can naturally also be used for other types of lamp, in particular other circuit topologies with resonant starting. For operating a high-pressure discharge lamp, a sinusoidal AC operating voltage is required whose operating frequency is wobbled or swept with a sawtooth waveform in the range between 45 kHz and 55 kHz, usually at a clock rate of 100 Hz, depending on the geometry of the lamp burner. The sweeping operation generally prevents the excitation of acoustic resonances and thus contributes to the stabilization of the plasma arc. The output stage of an electronic ballast for the abovementioned operating frequency range is usually implemented using an LC resonant circuit. In order to reduce the amount of components and thus to implement the ballast in space-saving and cost-effective manner, the LC output circuit can also be designed, in addition to its impedance and filter behavior, such that the generation of the lamp starting voltage, which is typically at 3.5 kV to 5 kV depending on the lamp, is made possible for each resonant excitation. The possibility of resonant generation of the starting voltage represents a particular boundary condition in terms of the design and dimensioning of the LC circuit, since in this case both the inductance used and the capacitance used must have a sufficiently high energy-carrying capacity for it to be possible to reach the required starting voltage level. In the case of the inductance, an air gap must thus usually be provided.

High-pressure discharge lamps now have the property that, instead of the rated operating mode at rated lamp impedance being set immediately after the initial breakdown, the still cold lamp reacts with a gas-assisted breakdown and often becomes fully conductive for a short period of time, typically 0.5 μs to 100 μs, immediately after the initial breakdown, i.e. the operating voltage can be less than 5 V. As regards the resonant output circuit which is charged to the starting voltage, this represents a sudden short circuit by means of which the effective capacitances which are charged to the starting voltage (including the lamp line) are discharged correspondingly rapidly and abruptly. These short-term short-circuit currents may in this case rise to several 100 A depending on the level of the effective capacitance and the remaining line inductances.

This unsteady start-up behavior of a high-pressure lamp after the initial breakdown represents a stress situation for the components concerned, in particular for the capacitors in the resonant circuit as well as, as a result of stray currents, for those of the remaining electronics of the ballast, and this stress situation may often lead to failures and thus to the ballast being destroyed.

PRIOR ART

No measure is known from the prior art which can prevent this stress situation.

SUMMARY OF THE INVENTION

The object of the present invention is therefore to develop a generic ballast such that it makes possible improved, in particular more reliable, lamp start-up. Here the intention is, in particular, to reduce the stress to which the components are subjected and thus to achieve a longer life for such a ballast.

The invention is based on the knowledge that, immediately after the initial breakdown, the current can be held below a predeterminable, still acceptable threshold if a braking inductance is arranged in series with the lamp.

In the context of the present application, for alternating current purposes is understood to mean the circuit structure which is produced in the AC equivalent circuit diagram. For example, the resonant capacitance is arranged for alternating current purposes in parallel with the first and second connections for the lamp if it is connected directly to ground or is coupled indirectly, for example via a power supply, to ground, or combinations of these two variants.

One preferred embodiment is characterized in that the resonant inductance and the first braking inductance are wound onto a common core. This design is based on the knowledge that a separate braking inductance which is not wound onto the core of the resonant inductance likewise needs to be large in order for it to be able to carry the same energy as the resonant inductance. In particular, it would thus likewise have to have a core with an air gap. The measure in this preferred embodiment thus allows a saving of a core to be made. This results in a reduction in costs and in the physical size.

It is preferable in this case for the winding sense of the resonant inductance and this braking inductance on the core to be the same.

However, the use of only one braking inductance which is wound onto the same core and in the same winding sense as the resonant inductance results in components of the square-wave voltage signal being transmitted from the resonant inductance, which at the same time represents the filter inductance during rated operation, to the first braking inductance at the junction point between the two switches, and, as a result, in there being harmonics in the spectrum of the current controlling the lamp. A signal is thus applied to the lamp which has square-wave components and in the case of sensitive lamps leads to the disadvantages known to those skilled in the art, for example poor illumination levels, an increase in the risk of the lamp being extinguished, etc.

This problem can be counteracted by a second braking inductance being provided which is arranged in series with the resonant capacitance. The first and the second braking inductances are preferably equal in value.

If the resonant inductance and the first and the second braking inductances are wound onto the same core, in particular with the same winding sense, during rated operation the effects of the two braking inductances compensate for one another, and the resonant arrangement including its filter effect is identical to the arrangement with only a single resonant inductor.

On the other hand, after the initial breakdown the effects of the first and the second braking inductances are not completely eliminated. That is to say a remaining stray inductance, which likewise has the full current- and energy-carrying capacity and which can thus limit the level of the discharge current through the lamp sufficiently well after the initial breakdown, is produced owing to loose coupling.

It is preferable for the stray inductance resulting from the coupling of the first and the second braking inductances to be at least 10 μH, preferably at least 40 μH.

The values for the braking inductances themselves are preferably at least 60 μH, even more preferably at least 120 μH.

It can be stressed, quite generally, that the first braking inductance or the first and the second braking inductances, depending on how sensitive the lamp is which it is used to operate, limit the current through the lamp after the initial breakdown in the lamp to a maximum of 50 A, preferably to a maximum of 30 A.

As is obvious to those skilled in the art, it is irrelevant for the implementation of the invention whether an LC resonant circuit for the rated operation of the lamp and an LC resonant starting circuit are formed separately or are implemented by one and the same LC circuit.

Further advantageous embodiments are described in the subclaims.

BRIEF DESCRIPTION OF THE DRAWINGS

Exemplary embodiments of the invention will now be described in more detail below with reference to the attached drawings, in which.

DETAILED DESCRIPTION OF THE INVENTION

Figure 1:
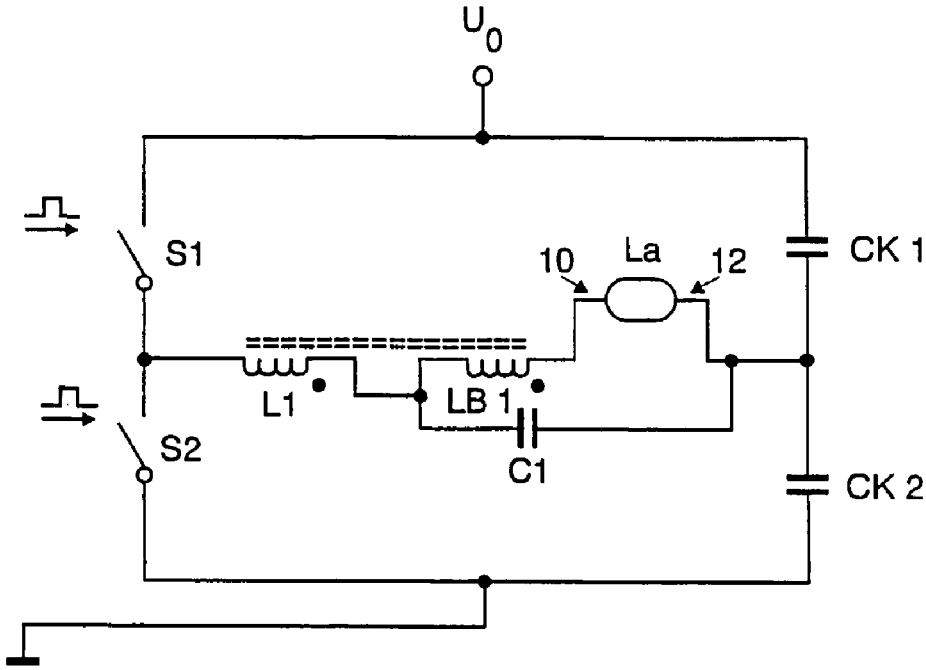
FIG. 1 shows a first exemplary embodiment of a ballast according to the invention having a braking inductance.

FIG. 1 shows a first exemplary embodiment of a ballast according to the invention. Two switches $S_1$ and $S_2$ are provided which are opened and closed in reciprocal fashion. Corresponding control circuits have long been known to those skilled in the art. They are supplied by a supply voltage $U_0$ which is also connected to two coupling capacitors $C_{K1}$ and $C_{K2}$. A lamp La is connected to a resonant starting circuit which has a resonant inductance $L_1$ and a resonant capacitance $C_1$. In order to control the discharge current of the effective capacitances directly after the initial breakdown, a braking inductance $L_{B1}$ is provided which is arranged in series with the lamp La and, to be precise, between the lamp La and the resonant inductance $L_1$. For optimum control of the discharge current, the braking inductance $L_{B1}$ must have the same energy-carrying capacity as the resonant inductance $L_1$ used for generating the resonant voltage. As illustrated, the resonant inductance $L_1$ and the braking inductance $L_{B1}$ are coupled with the same winding sense.

Figure 2:
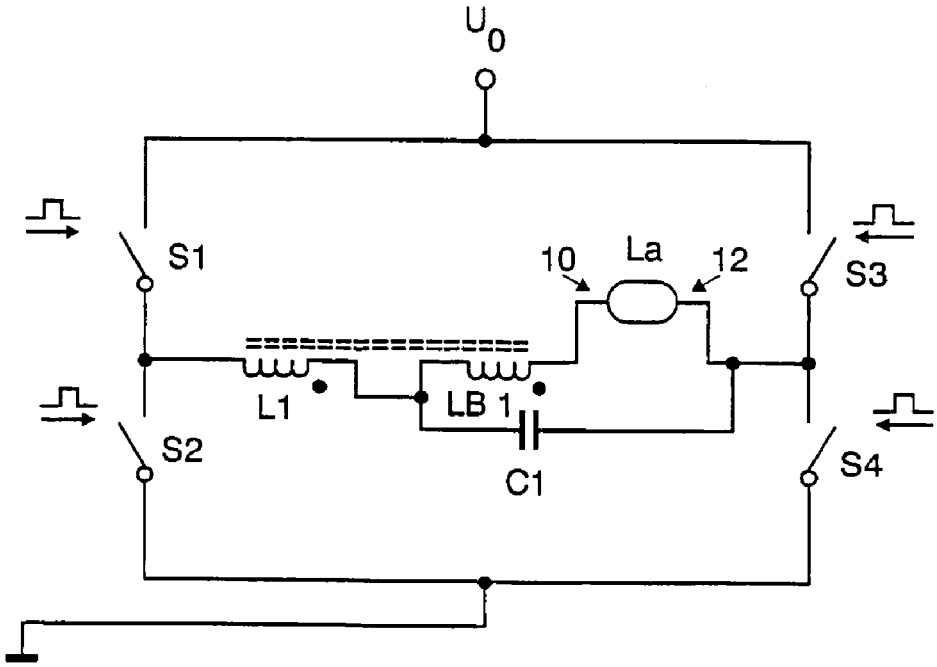
FIG. 2 shows a second exemplary embodiment of a ballast according to the invention having a braking inductance.

Whilst FIG. 1 shows a ballast according to the invention having a half-bridge arrangement, FIG. 2 shows an exemplary embodiment having a full-bridge arrangement in which the coupling capacitors $C_{K1}$ and $C_{K2}$ are replaced by switches $S_3$ and $S_4$.

Figure 3:
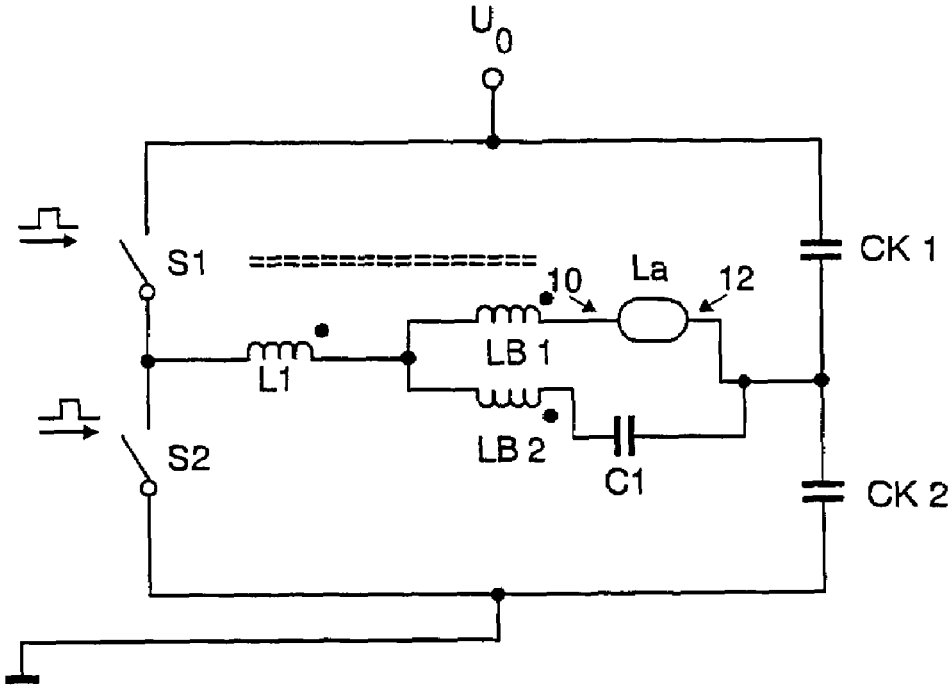
FIG. 3 shows a third exemplary embodiment of a ballast according to the invention having two braking inductances.

In the exemplary embodiment illustrated in FIG. 3 of a ballast according to the invention, a second braking inductance $L_{B2}$ is provided which is arranged in series with the resonant capacitance. It is wound onto the same core as the resonant inductance $L_1$ and the first braking inductance $L_{B1}$, in particular also with the same winding sense.

The air gap is preferably arranged below the second braking inductance in order to produce a stray inductance having a sufficiently high value.

The effective braking inductance is accordingly the stray inductance $L_{stray}$ resulting from the coupling of the first braking inductance $L_{B1}$ to the second braking inductance $L_{B2}$. $L_{stray}$ is at least 10 μH, preferably at least 40 μH. If all of the effective capacitances are combined to form one effective capacitance C and U is the voltage across such an effective capacitance, the maximum current $I_{max}$ is produced as $$I_{\max} = \sqrt{\frac{\frac{1}{2}CU^2}{\frac{1}{2}L_{stray}}}$$

The braking inductance(s) is/are dimensioned such that the current through the lamp after the initial breakdown is limited to a maximum of 50 A, preferably to a maximum of 30 A.

Figure 4:
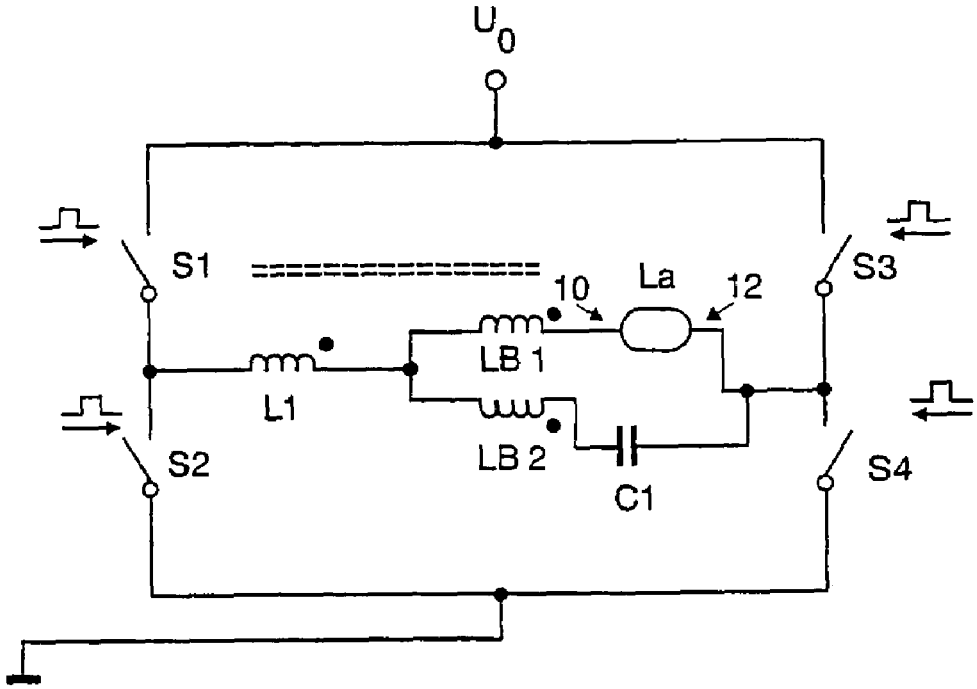
FIG. 4 shows a fourth exemplary embodiment of a ballast according to the invention having two braking inductances.

FIG. 4 shows the ballast according to the invention illustrated in FIG. 3 in a full-bridge arrangement, the coupling capacitors $C_{K1}$ and $C_{K2}$ again being replaced by switches $S_3$ and $S_4$.

In the exemplary embodiments shown in FIGS. 1–4, the braking inductance $L_{B1}$, which is connected in series with the lamp, is always connected between the lamp La and the resonant inductance $L_1$. That is to say the braking inductance $L_{B1}$, which is connected in series with the lamp, is connected to the connection of the lamp La which is coupled to the resonant starting circuit. Prior to starting, this connection has a high voltage compared with a ground potential. If the lamp La is connected to the ballast by means of a relatively long cable, a parasitic capacitance is formed between said connection of the lamp La and the ground potential and this parasitic capacitance may have a value of several hundred picofarads. In the exemplary embodiments shown in FIGS. 1–4, during the gas-assisted breakdown in the lamp La the energy stored in the parasitic capacitance may be discharged unbraked via a circuit-breaker or ground connection. This discharge may lead to the ballast being damaged or destroyed, in particular because discharge currents flow via grounding lines and thus reference potentials of the ballast are shifted.

Figure 5:
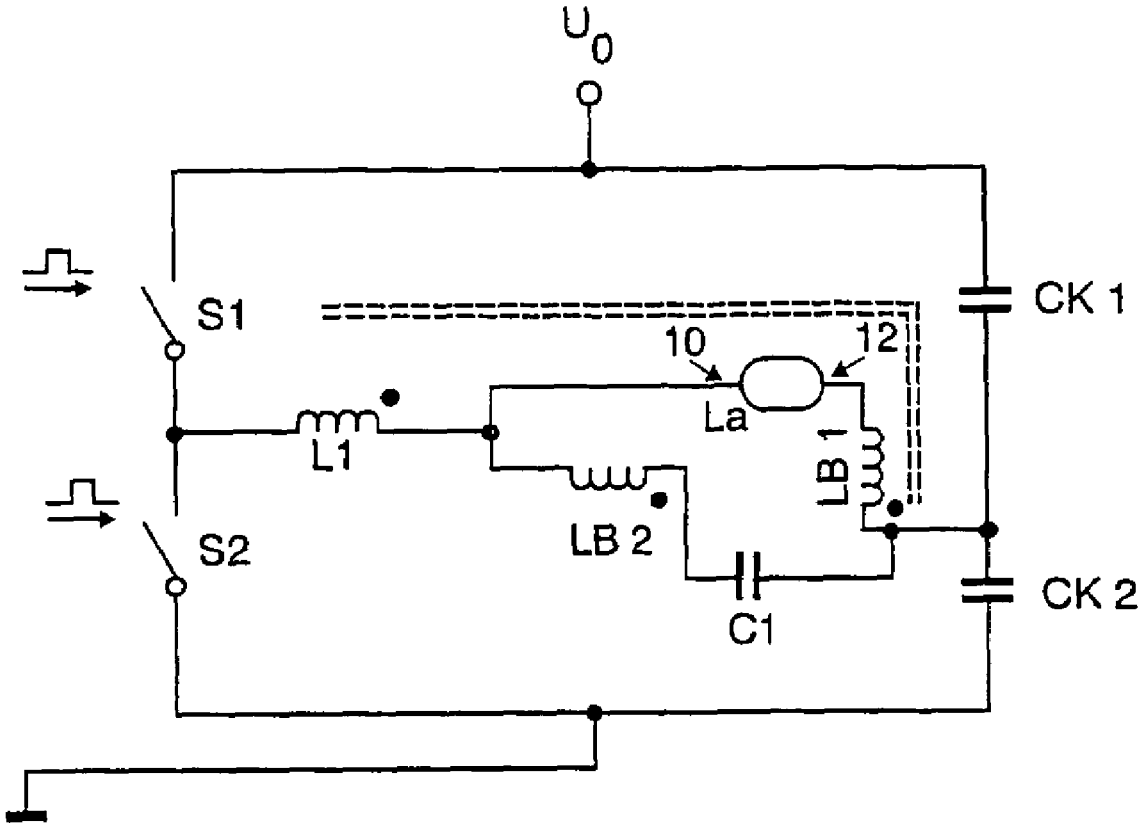
FIG. 5 shows a fifth exemplary embodiment of a ballast according to the invention having two braking inductances.

An exemplary embodiment of a ballast according to the invention in accordance with FIG. 5 acts as a remedy against high discharge currents from parasitic capacitances. This exemplary embodiment essentially corresponds to the exemplary embodiment from FIG. 3.

The difference from FIG. 3 consists in the lamp La now being connected between the braking inductance $L_{B1}$ and the resonant inductance $L_1$. The braking inductance $L_{B1}$ is thus connected to the lamp connection given the designation 12. This alternative arrangement of the braking inductance $L_{B1}$ causes discharge currents from parasitic capacitances to flow through the braking inductance $L_{B1}$ and thus the value of these discharge currents also to be reduced. Discharge currents from parasitic capacitances can also not damage or destroy the ballast in the exemplary embodiment shown in FIG. 5.

The above embodiments for the winding sense and couplings also apply to this braking inductance $L_{B1}$.

The exemplary embodiment shown in FIG. 5 shows an alternative arrangement of the braking inductance $L_{B1}$ in comparison to the exemplary embodiment shown in FIG. 3. The exemplary embodiments from FIGS. 1, 2 and 4 may also correspondingly have the alternative arrangement of the braking inductance $L_{B1}$. This is advantageous if parasitic capacitances to the ground potential have high values. If symmetrical circuitry is desired for the lamp La, the braking inductance $L_{B1}$ may also be split up and arranged on both sides of the lamp La.

The invention claimed is:

1. A ballast for powering at least one lamp (La), the ballast comprising:

at least two switches ($S_1$, $S_2$) arranged in series;

a control circuit for alternately opening and closing the at least two switches ($S_1$, $S_2$);

a connection for applying a supply voltage ($U_0$) to the at least two switches ($S_1$, $S_2$);

a resonant starting circuit coupled on an input side to a junction point between the at least two switches ($S_1$, $S_2$) and coupled on an output side to a first connection (10) for the lamp (La), the resonant starting circuit comprising:

a resonant inductance ($L_1$) arranged in series with the junction point between the at least two switches ($S_1$, $S_2$) and in series with the first connection (10) for the lamp (La);

a resonant capacitance ($C_1$) arranged for alternating current purposes in parallel with the first connection (10) for the lamp (La) and a second connection (12) for the lamp (La);

a first braking inductance ($L_{B1}$) which, for alternating current purposes, is firstly arranged in series with the lamp (La) and secondly arranged in parallel with the resonant capacitance ($C_1$); and a second braking inductance ($L_{B2}$) which is arranged in series with the resonant capacitance ($C_1$).

2. The ballast as claimed in claim 1, wherein the first and the second braking inductances ($L_{B1}$, $L_{B2}$) are equal in value.

3. The ballast as claimed in claim 1, wherein the resonant inductance ($L_1$) and the first and the second braking inductances ($L_{B1}$, $L_{B2}$) are wound onto the same core.

4. The ballast as claimed in claim 1, wherein the winding sense of the resonant inductance ($L_1$) and the winding senses of the first and the second braking inductances ($L_{B1}$, $L_{B2}$) are the same.

5. The ballast as claimed in claim 1, wherein the coupling of the first and the second braking inductances ($L_{B1}$, $L_{B2}$) produces a stray inductance ($L_{stray}$) which is at least 10 μH, and which is preferably at least 40 μH.

6. The ballast as claimed in claim 1, wherein each braking inductance ($L_{B1}$, $L_{B2}$) is at least 60 μH, and which is preferably at least 120 μH.

7. The ballast as claimed in claim 1, wherein the first and the second braking inductances ($L_{B1}$, $L_{B2}$) are designed to limit the current ($I_{max}$) through the lamp (La) after the initial breakdown in the lamp (La) to a maximum of 50 A, and preferably to a maximum of 30 A.

8. The ballast as claimed in claim 1, wherein the first braking inductance ($L_{B1}$) is connected between the lamp (La) and the resonant inductance ($L_1$).

9. A ballast for powering at least one lamp (La), the ballast comprising:

at least two switches ($S_1$, $S_2$) arranged in series;

a control circuit for alternately opening and closing the at least two switches ($S_1$, $S_2$);

a connection for applying a supply voltage ($U_0$) to the at least two switches ($S_1$, $S_2$);

a resonant starting circuit coupled on an input side to a junction point between the at least two switches ($S_1$, $S_2$) and coupled on an output side to a first connection (10) for the lamp (La), the resonant starting circuit comprising:

a resonant inductance ($L_1$) arranged in series with the junction point between the at least two switches ($S_1$, $S_2$) and in series with the first connection (10) for the lamp (La);

a resonant capacitance ($C_1$) arranged for alternating current purposes in parallel with the first connection (10) for the lamp (La) and a second connection (12) for the lamp (La); and a first braking inductance ($L_{B1}$) which, for alternating current purposes, is firstly arranged in series with the lamp (La) and secondly arranged in parallel with the resonant capacitance ($C_1$), wherein the lamp (La) is connected between the first braking inductance ($L_{B1}$) and the resonant inductance ($L_1$).

10. The ballast as claimed in claim 9, wherein the resonant inductance ($L_1$) and the first braking inductance ($L_{B1}$) are wound onto a common core.

11. The ballast as claimed in claim 10, wherein the winding sense of the resonant inductance ($L_1$) and the first braking inductance ($L_{B1}$) on the core is the same.

* * * * *